US011363367B1

(12) United States Patent
Haartsen et al.

(10) Patent No.: US 11,363,367 B1
(45) Date of Patent: Jun. 14, 2022

(54) DUAL-MICROPHONE WITH WIND NOISE SUPPRESSION METHOD

(71) Applicant: Dopple IP B.V., Emmen (NL)

(72) Inventors: Jacobus Cornelis Haartsen, Rolde (NL); Aalbert Stek, Emmen (NL)

(73) Assignee: Dopple IP B.V., Emmen (NL)

( * ) Notice: Subject to any disclaimer, the term of this patent is extended or adjusted under 35 U.S.C. 154(b) by 0 days.

(21) Appl. No.: 17/106,446

(22) Filed: Nov. 30, 2020

(51) Int. Cl.
*H04R 1/10* (2006.01)
*H04R 3/00* (2006.01)

(52) U.S. Cl.
CPC ..... *H04R 1/1083* (2013.01); *H04R 3/005* (2013.01); *H04R 2201/107* (2013.01); *H04R 2410/07* (2013.01)

(58) Field of Classification Search
CPC ..... H04R 1/1083; H04R 3/005; H04R 2201/107; H04R 2410/07
USPC ..... 381/71.1, 71.14, 81, 94.1, 94.2, 94.5
See application file for complete search history.

(56) References Cited

U.S. PATENT DOCUMENTS 10,841,693 B1 * 11/2020 Ganeshkumar ..... G10K 11/34
2011/0208520 A1 * 8/2011 Lee ..... G10L 25/78 704/E15.039
2015/0319527 A1 * 11/2015 Petit ..... H04R 1/406 381/71.1

* cited by examiner

*Primary Examiner* — William A Jerez Lora
(74) *Attorney, Agent, or Firm* — David Owen; Hoyng Rokh Monegier

(57) ABSTRACT

A dual-microphone arrangement (300) provides improve voice performance in a wireless headset (12). A vibration sensor (1130) is used for voice pickup and will add low-frequency voice audio content in windy conditions. An equalizer (810) is used to restore low-frequency voice audio content in wind-free conditions. Depending on the measured wind power, the output will derive more signal from the equalizer (810) or more signal from the vibration sensor (1130).

19 Claims, 19 Drawing Sheets

DUAL-MICROPHONE WITH WIND NOISE SUPPRESSION METHOD

TECHNICAL FIELD

The present invention relates generally to audio devices and in particular to wireless headsets with multiple microphones and vibration detectors for voice quality enhancement in windy conditions.

BACKGROUND ART

The use of headsets wirelessly connected to host devices like smartphones, laptops, and tablets is becoming increasingly popular. Whereas consumers used to be tethered to their electronic device with wired headsets, wireless headsets are gaining more traction due to the enhanced user experience, providing the user more freedom of movement and comfort of use. Further momentum for wireless headsets has been gained by certain smartphone manufacturers abandoning the implementation of the 3.5 mm audio jack in the smartphone, and promoting voice communications and music listening wirelessly, for example by using Bluetooth® technology.

Wireless headsets typically have one or more microphones to pick up the voice of the user. This allows the user to make hands-free phone calls. The use of two or more microphones allows the application of beamforming, thus enhancing the voice pickup and providing the possibility of noise reduction.

Wind noise has always been hindering the use of wireless headsets, not only in windy weather conditions, but also wind created by cycling or other sports activities. Wind itself incident on the microphone membrane cause undesired noise. Furthermore, turbulences caused by wind flowing around the edges of acoustic canals that lead to the microphones, contribute greatly to the wind noise. One method to counteract wind noise has been the use of vibration sensors to pick up the voice instead. These sensors pick up the vibrations in the human body caused by the voice excitement. Vibration can be picked up at the skin (Skin Surface Microphones), from bones (Bone Conduction microphone), or from other tissues in the user's head. The vibration sensor can for example be implemented by an accelerometer which may use MEMS technology. Since the vibration sensor is not excited by displacement of air, it is insensitive to wind noise. Yet, vibration sensors and its use are hampered by low filtering characteristics. That is, high frequencies are damped in the tissues and are not picked up by the vibration sensors. This makes the voice sound unnatural. Wireless headsets with improved microphone performance in windy noise conditions are therefore desirable.

The Background section of this document is provided to place embodiments of the present invention in technological and operational context to assist those of skill in the art in understanding their scope and utility. Unless explicitly identified as such, no statement herein is admitted being prior art merely by its inclusion in the Background section.

SUMMARY

The following presents a simplified summary of the disclosure in order to provide a basic understanding to those of skill in the art. This summary is not an extensive overview of the disclosure and is not intended to identify key/critical elements of embodiments of the invention or to delineate the scope of the invention. The sole purpose of this summary is to present some concepts disclosed herein in a simplified form as a prelude to the more detailed description that is presented later.

According to one or more embodiments described and claimed herein, novel and nonobvious aspects of multiple microphones combined with an equalizer and a vibration sensor provide improved voice performance in a wireless stereo headset. By exploiting beam-forming using a dual-microphone arrangement with equalization, gain in voice pickup is achieved while keeping a natural sound in low-wind conditions. When wind is detected, the system gradually switches over to a voice pickup by a vibration sensor which is insensitive to wind.

Hereinafter, embodiments of the disclosure will be described in further detail. It should be appreciated, however, that these embodiments may not be construed as limiting the scope of protection for the present disclosure.

BRIEF DESCRIPTION OF DRAWINGS

Embodiments will now be described, by way of example only, with reference to the accompanying schematic drawings in which corresponding reference symbols indicate corresponding parts, and in which.

The figures are meant for illustrative purposes only, and do not serve as restriction of the scope or the protection as laid down by the claims.

DESCRIPTION OF EMBODIMENTS

For simplicity and illustrative purposes, the present invention is described by referring mainly to exemplary embodiments thereof. In the following description, numerous specific details are set forth in order to provide a thorough understanding of the present invention. However, it will be readily apparent to one of ordinary skill in the art that the present invention may be practiced without limitation to these specific details. In this description, well known methods and structures have not been described in detail so as not to unnecessarily obscure the present invention.

Electronic devices, such as mobile phones and smartphones, are in widespread use throughput the world. Although the mobile phone was initially developed for providing wireless voice communications, its capabilities have been increased tremendously. Modern mobile phones can access the worldwide web, store a large amount of video and music content, include numerous applications ("apps") that enhance the phone's capabilities (often taking advantage of additional electronics, such as still and video cameras, satellite positioning receivers, inertial sensors, and the like), and provide an interface for social networking. Many smartphones feature a large screen with touch capabilities for easy user interaction. In interacting with modern smartphones, wearable headsets are often preferred for enjoying private audio, for example voice communications, music listening, or watching video, thus not interfering with or disturbing other people sharing the same area. Because it represents such a major use case, embodiments of the present invention are described herein with reference to a smartphone, or simply "phone" as the host device. However, those of skill in the art will readily recognize that embodiments described herein are not limited to mobile phones, but in general apply to any electronic device capable of providing audio content.

Figure 1:
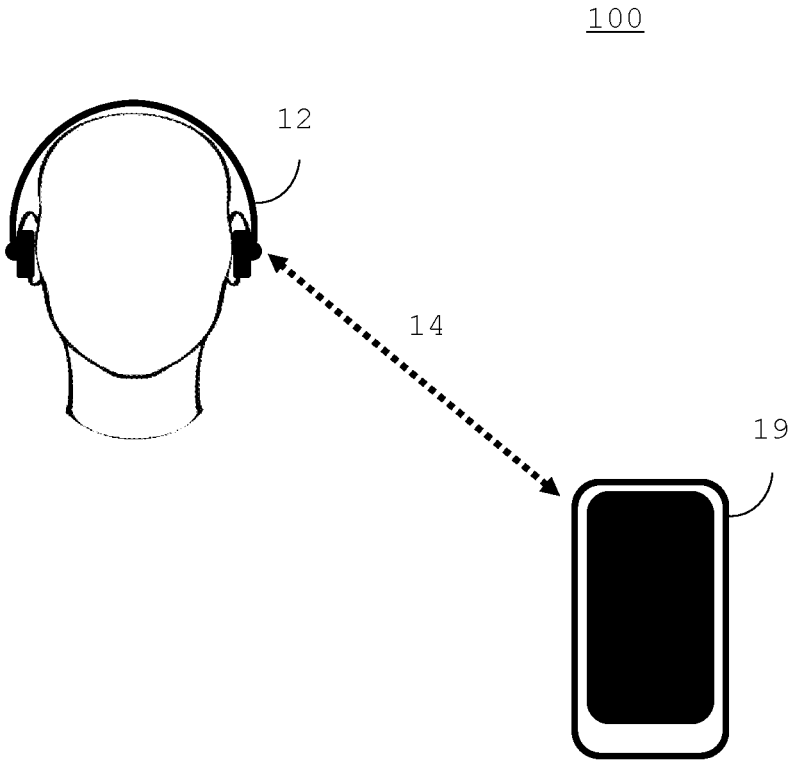
FIG. 1 shows an exemplary use scenario of a user wearing a wireless stereo headset and wirelessly communicating with a host device.

FIG. 1 depicts a typical use case 100, in which a host device 19, such as a smartphone, contains audio content which can stream over wireless connection 14 towards the headset 12. Headset 12 may alternatively or additionally have communication capabilities to make a hands-free phone call via host device 19. Headset 12 may be a mono device, for example consisting of one unit. Headset 12 may be a stereo device, for example consisting of two ear pieces, either separate or connected via string.

Figure 2:
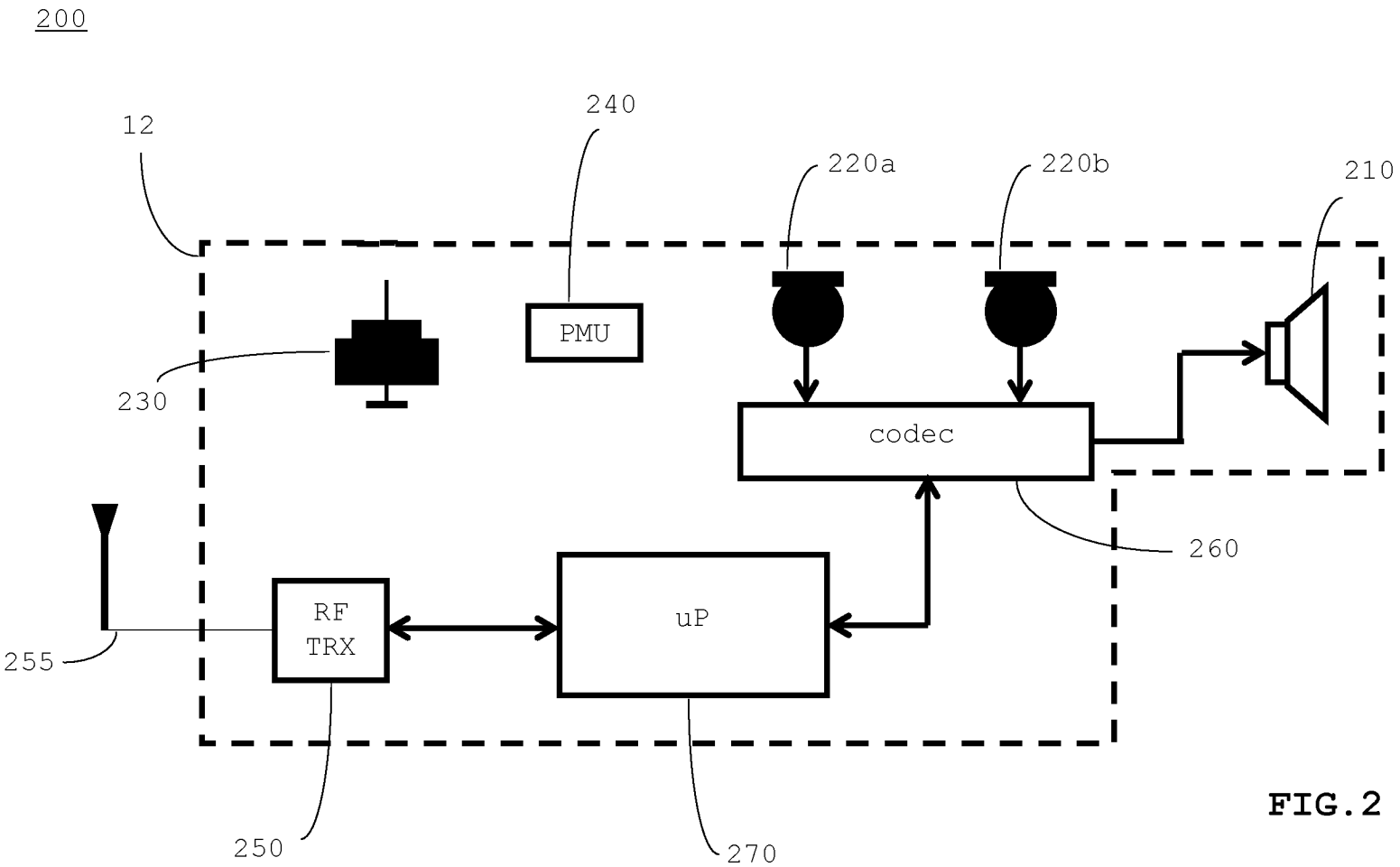
FIG. 2 is a block diagram of a first exemplary wireless stereo headset with a dual microphone.

FIG. 2 depicts a high-level block diagram 200 of an exemplary wireless headset 12 consistent with embodiments of the present invention. A wireless mono headset is shown, but it will be readily apparent to one of ordinary skill in the art that the invention can also be used in a wireless stereo headset. Wireless communication between the phone 19 (or any other host device) and the headset 12 may be provided by an antenna 255 and a radio transceiver 250. Radio transceivers 250 may be a low-power radio transceiver covering short distances, for example a radio based on the Bluetooth® wireless standard (operating in the 2.4 GHz ISM band). The use of the radio transceiver 250, which by definition provides two-way communication capability, preferably allows for efficient use of airtime (and consequently low power consumption) for example by enabling the use of a digital modulation scheme with an automatic repeat request (ARQ) protocol.

A microprocessor 270 may control the radio signals, applying audio processing (for example voice processing such as echo cancellation or noise suppression) on the signals exchanged with radio transceiver 250, or may control other devices and/or signal paths within the headset 12. Microprocessor 270 may be a separate circuit, or may be integrated into another component present in the headset, for example radio transceiver 250.

Audio codec 260 may include a Digital-to-Analog (D/A) converter, the output of which may connect to a speaker 210. To obtain beamforming for enhanced voice pickup, more than one microphone 220*a*, 220*b* may be embedded in headset 12. Audio codec 260 may include Analog-to-Digital (A/D) converters that receive input signals from microphones 220*a* and 220*b*. Alternatively, digital microphones may be used, which do not require A/D conversion and may provide digital audio signals directly to the audio codec 260 or the microprocessor 270.

Power Management Unit (PMU) 240 may provide a stable voltage and current supplied to all electronic circuitry. The headset 12 may be powered by a battery 230 which typically provides a 3.7V voltage and may be of the coin cell type. The battery 230 can be a primary battery but is preferably a rechargeable battery. Recharging circuitry may be included in the PMU 240.

Figure 3:
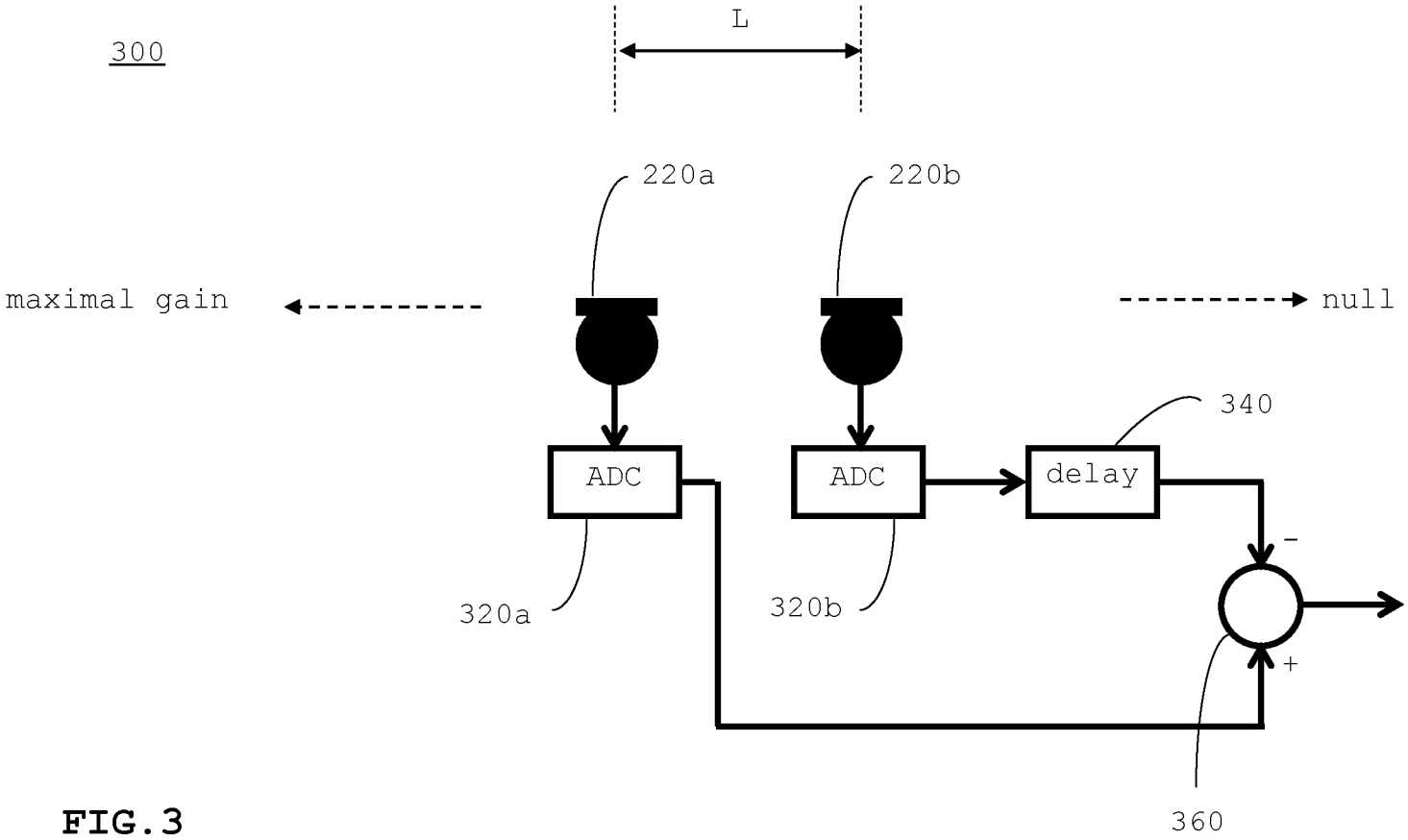
FIG. 3 is a circuit diagram of a dual-microphone arrangement according to the current invention.

FIG. 3 depicts a block diagram 300 of a dual-microphone arrangement. A/D convertors 320*a* and 320*b* may map the analog microphone signals from microphones 220*a* and 220*b* into the digital domain, respectively. The analog signal is time sampled, for example with a sampling frequency of 32 kHz, and the amplitude of the analog signal is quantized, for example using 24 bits. The digital signal from microphone (MIC) 220*b* may be delayed in delay unit 340. The delayed signal from microphone 220*b* may be subtracted from the signal from microphone 220*a* in subtractor 360. Sound coming from the right may first arrive at MIC 220*b* and a little later at MIC 220*a*. The propagation delay $\tau_p$ via the air between MIC 220*b* and MIC 220*a* depends on the distance L between the microphones 220*a*, 220*b* and the velocity of sound $v_s$; $\tau_p = L/v_s$. If the delay $\tau_d$ realized in unit 340 is the same as the propagation delay $\tau_p$, the signals input to the subtractor 360 are identical and will cancel. Therefore, a sound source from the right will not be detected. On the other hand, a sound from the left will be delayed before it arrives at MIC 220*b* where after it is delayed again in delay unit 340 before it arrives at the subtractor 360. The impulse response of the dual-MIC arrangement for a sound source from the left will be:

$$h(t)=\delta(t)-\delta(t-\tau_p-\tau_d)$$

with a frequency response:

$$H_{DMIC}(f)=1-e^{-j2\pi f(\tau_p+\tau_d)}$$

The maximum gain of 6 dB is realized if $2\pi(\tau_p+\tau_d)=\pi$. As an example, when we assume the velocity of sound $v_s$ to be 343 m/s and the distance L between the MICs to be 11 mm, the propagation delay amounts to $\tau_p=L/v_s=33.07$ μs. The delay in unit 340 can then simply be realized by delaying the sampled digital audio signal by one sample, assuming a sampling frequency of 32 kHz. The maximum gain for a sound source at the left is then realized at frequency:

$$f_{max}=\frac{1}{2(\tau_p+\tau_d)}=7.8\text{ kHz}$$

Integer sample delays are easy to implement, but also non-integer sample delays can be implemented digitally. For example, by using a two-tap filter with inter-tap delay of one time sample and filter coefficients a1 and a2, any delay between 0 and one time sample can be achieved by a proper selection of the a1 and a2 coefficients.

Figure 4:
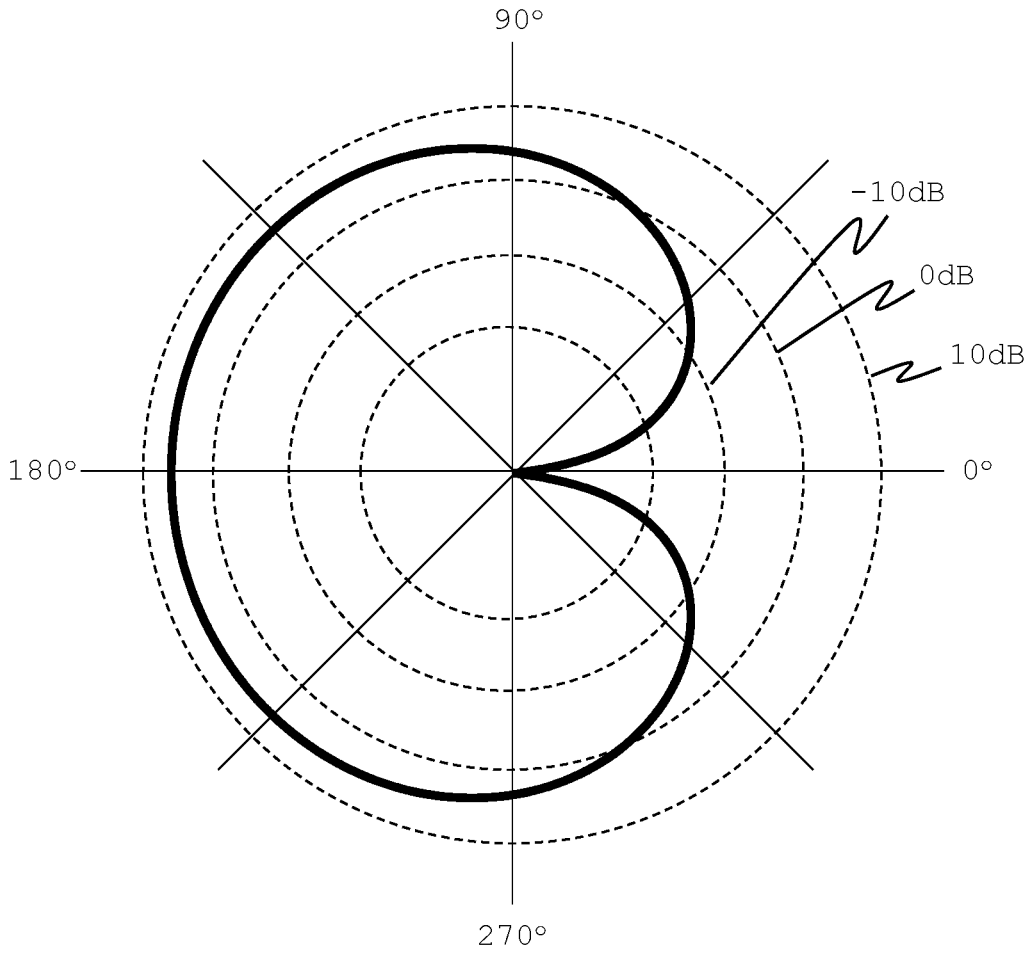
FIG. 4 is a logarithmic gain response of the dual-microphone arrangement depending on direction angle.

So far, we have only considered sound from the right and from the left. If the sound source is at another angle, the propagation delay will be dependent on this angle. The gain as a function of the angle for the dual-MIC arrangement 300 is visualized in FIG. 4. For an angle of 0 degrees, there is a null (maximal suppression) in the gain diagram. For an angle of 180 degrees, there is a maximum (typically 6 dB for signals with frequency of 7.8 kHz). FIG. 4 shows the beam-forming behavior of the dual-MIC arrangement 300. In this case, the delay is giving a cardioid beam pattern. The delay can also be tuned to other beam patterns like super- or hyper-cardioid patterns.

Figure 5:
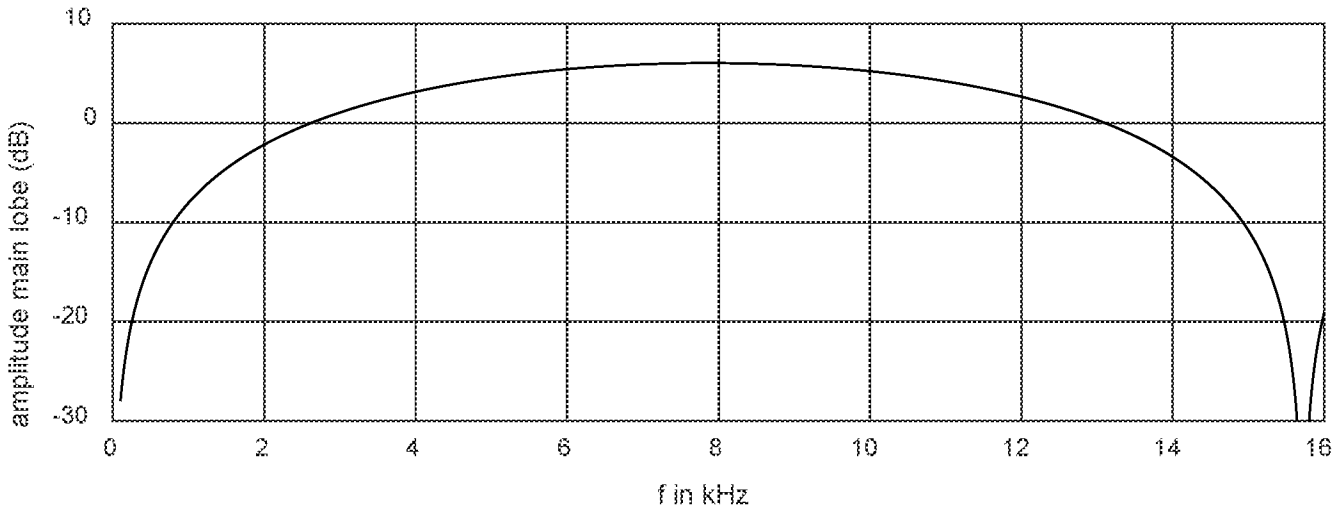
FIG. 5 is a frequency response of the dual-microphone arrangement in the direction with maximal gain.

FIG. 5 depicts the gain for angle 180 degrees as a function of the frequency. It is confirming that the maximum gain is achieved for $f_{max}=7.8$ kHz. It is also observed that the dual-MIC arrangement 300 has a bandpass filter characteristic. Low frequency components are greatly attenuated. The voice at the dual-MIC arrangement output will therefore sound metallic since all low-frequency content has been suppressed. High frequency components above 10 kHz are also attenuated, but this is less of a concern for voice signals. This is also visualized in FIG. 6A and FIG. 6B.

Figure 6A:
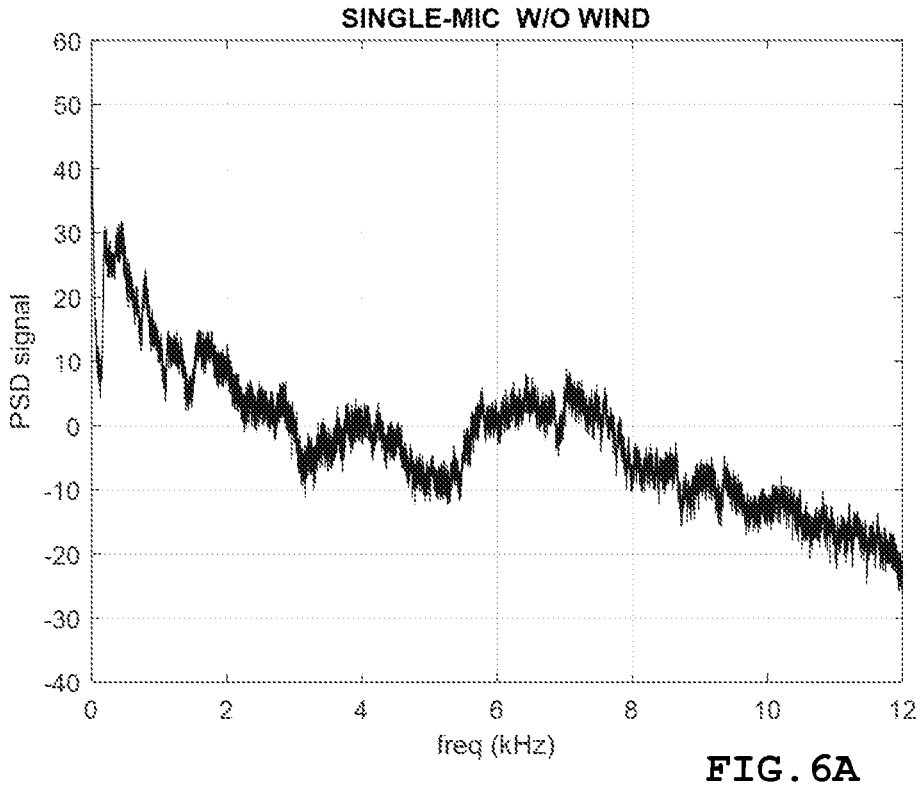
FIG. 6A shows a typical frequency spectrum of a 30 s female voice recorded by a single microphone.
Figure 6B:
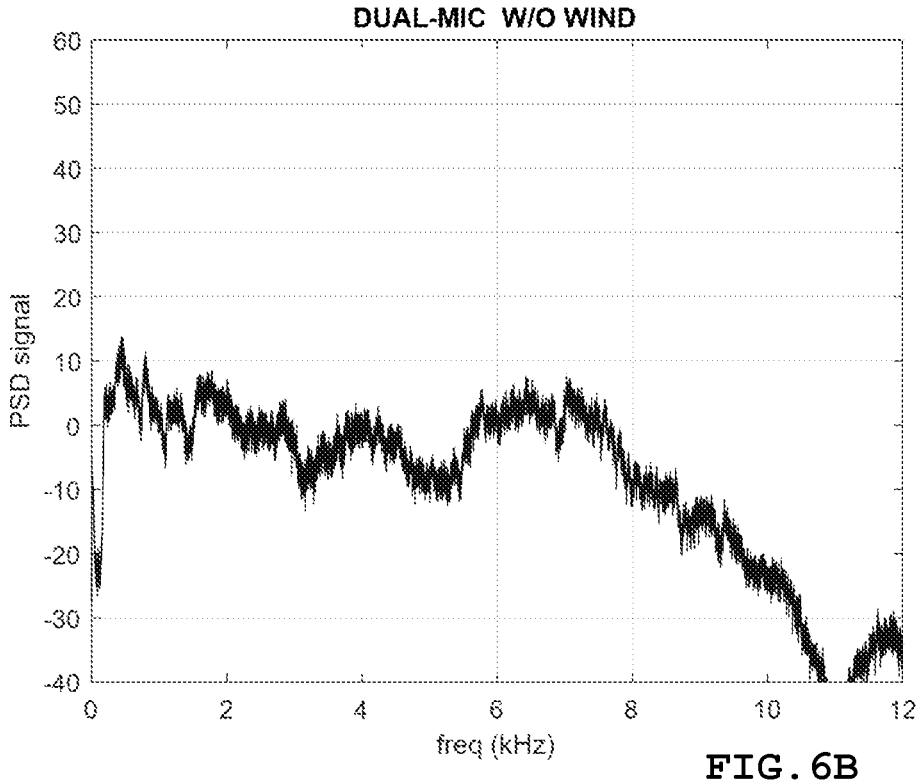
FIG. 6B shows a typical frequency spectrum of the same 30 s female voice recorded after the dual-microphone arrangement.

In FIG. 6A, the power spectrum of a female voice recorded for 30 s at a single MIC (e.g. MIC 220*a*) is shown. It is observed that there is quite an amount of voice content at the lower frequencies (below 2 kHz), but that up to 8 kHz, important information is to be found for making the voice sound natural. In FIG. 6B, the same voice is recorded at the output of the dual-MIC arrangement 300. It is observed that due to the high-pass characteristics, the frequency components below 2 kHz are greatly suppressed. Frequency components above 9 kHz are suppressed as well, but these are less important for the natural sound.

Figure 7:
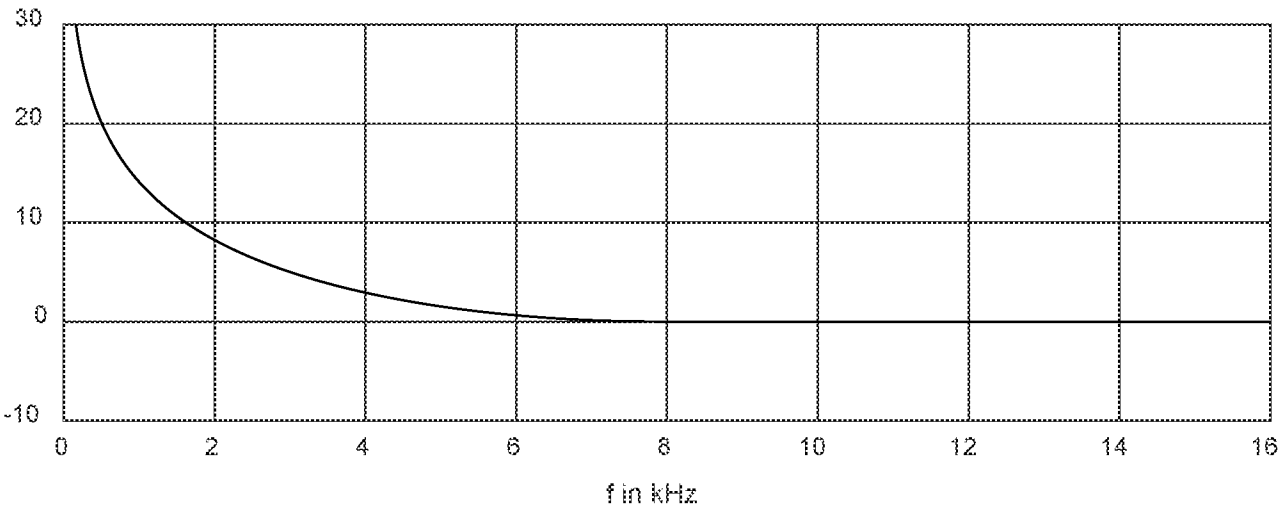
FIG. 7 shows a frequency response of an equalizer filter, equalizing the filter characteristic of the dual-microphone arrangement.

The lower frequency part can be restored by applying an equalizer filter. FIG. 7 depicts the frequency response of an equalizer filter suited to undo the high-pass behavior of the dual-MIC arrangement. The equalizer can be realized using the following equation:

$$\begin{aligned} H_{EQ}(f) &= \frac{1}{H_{DMIC}(50)} && \text{for } f_{min} < 50\text{ Hz} \\ &= \frac{1}{H_{DMIC}(f)} = \frac{1}{1-e^{-j2\pi f(\tau_p+\tau_d)}} && \text{for } 50\text{ Hz} < f < f_{max} \\ &= 1 && \text{for } f > f_{max} \end{aligned}$$

Herein, the lower cut-off frequency $f_{min}$ is arbitrarily chosen at 50 Hz. It should be low enough not to be noticeable by the listener and high enough to prevent $H_{eq}(f)$ to reach too high amplitudes. The higher cut-off frequency $f_{max}$ is arbitrarily chosen at 7.8 kHz, the frequency where the dual-MIC gain was maximal (see FIG. 5).

Figure 8:
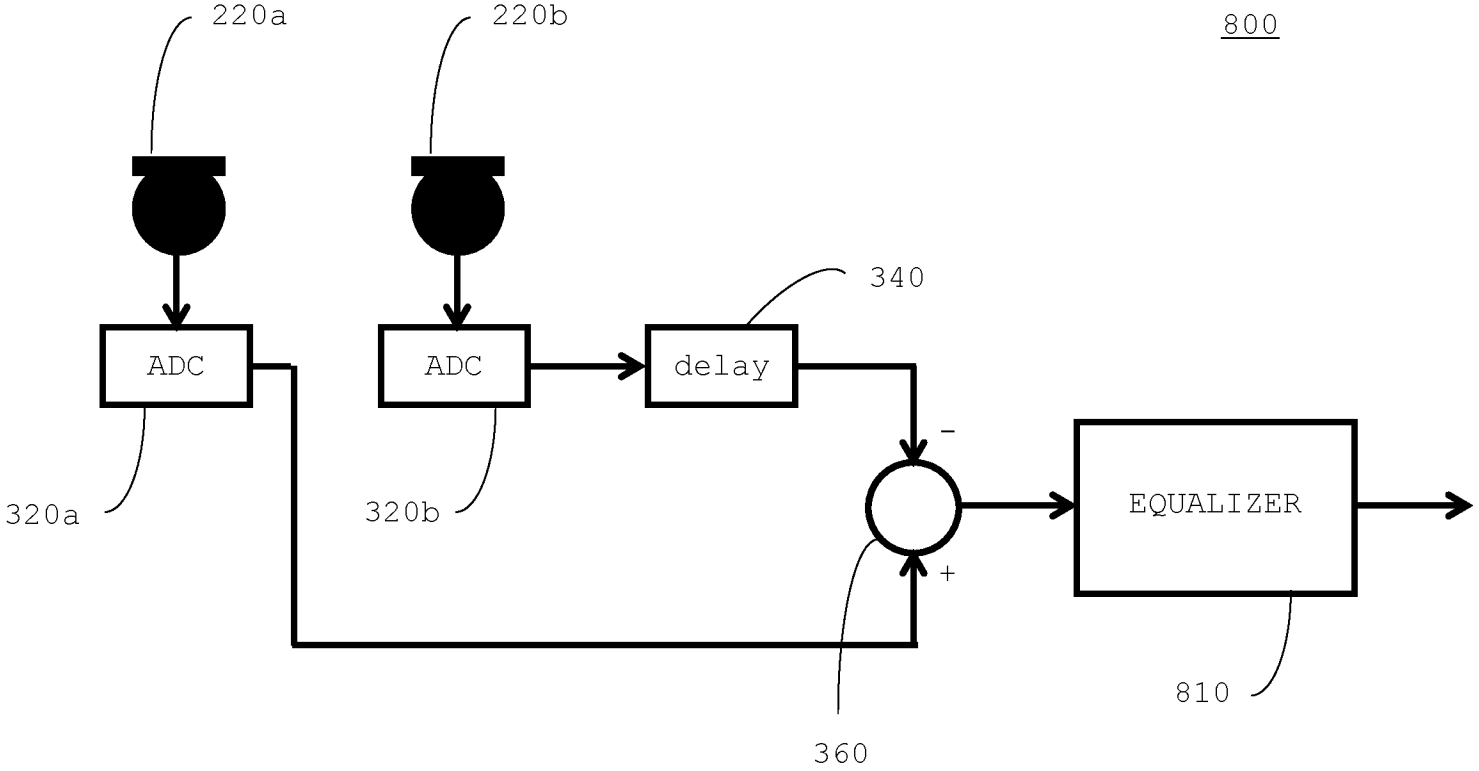
FIG. 8 is a circuit diagram of a dual-microphone arrangement and an equalizer to restore low-frequency audio content in low-wind conditions according to the current invention.

Cascading the dual-MIC arrangement 300 with an equalizer filter 810 as shown in the cascaded configuration 800 of FIG. 8 works particularly well in an indoor environment where the user is practically stationary. The equalizing filter 810 may emphasize the low frequency components which where earlier suppressed by the high-pass characteristics of the dual-MIC arrangement. As a result, the voice picked up does not sound metallic anymore but natural.

Figure 9A:
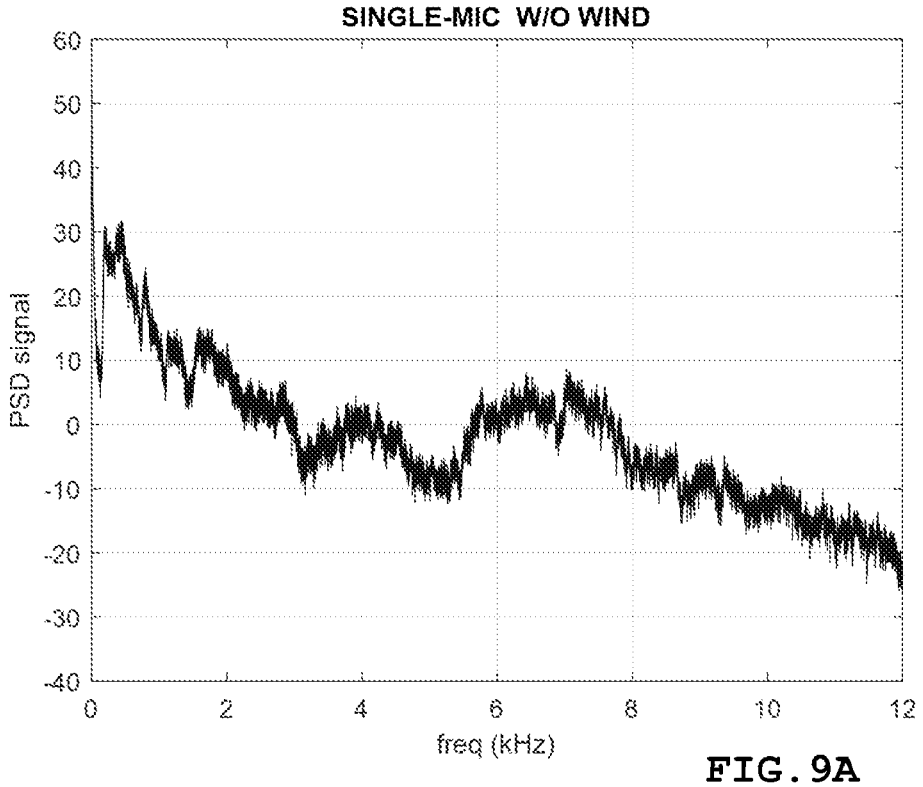
FIG. 9A shows a typical frequency spectrum of a 30 s female voice recorded by a single microphone.
Figure 9B:
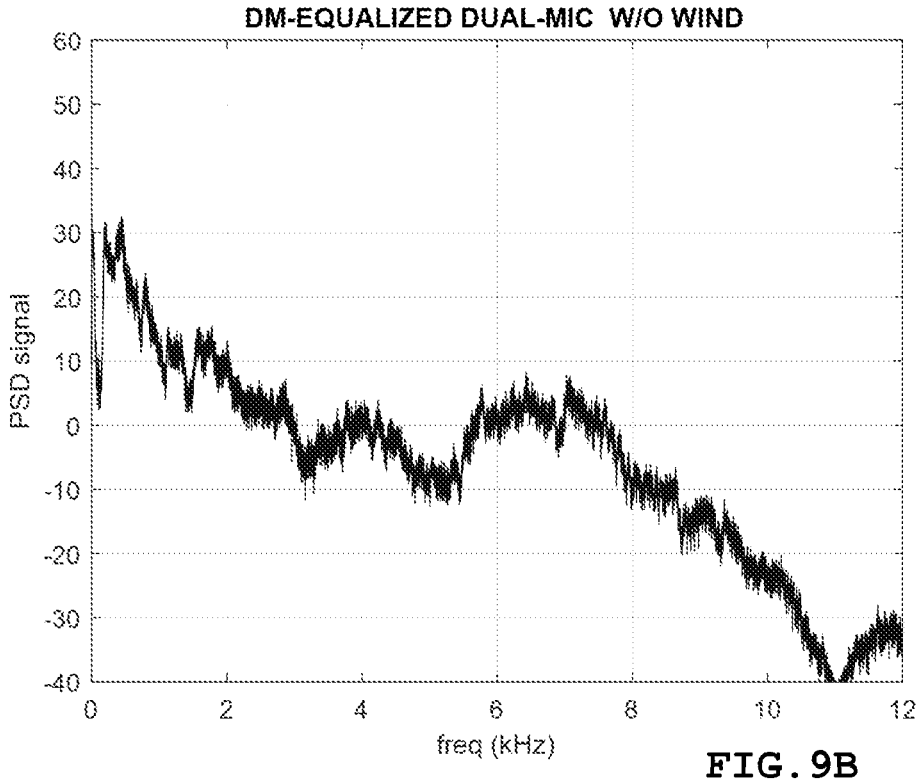
FIG. 9B shows a typical frequency spectrum of the same 30 s female voice recorded after the equalized dual-microphone arrangement.

The power spectrum of the same female voice recorded for 30 s at the output of the equalizer filter 810 is depicted in FIG. 9B. In FIG. 9A the original power spectrum picked up at a single MIC is shown again for reference. The curves shown in FIG. 9A and FIG. 9B are almost identical in particular in the frequency range below 8 kHz.

However, when there is an air flow along the headset, for example due to windy weather conditions or because the user is moving like biking or running, the wind noise may have a big impact on the cascaded configuration 800. There is very little correlation between the wind noise signals detected by each microphone. In fact, in the subtractor 360, the wind noise powers from the MIC signals may add up. But more importantly, the low frequency components of the uncorrelated wind noise signals are typically not suppressed by the high-pass filter behavior of the dual-microphone arrangement 300 (as would be the case with correlated signals like voice). The operation of the equalizer filter 810, emphasizing the lower frequency components, may now be disastrous as the wind signals at low frequency are strongly amplified causing a very bad Signal-to-Noise ratio (SNR) at the equalizer output. When the digital word size is not sufficient, clipping of the signal may occur. Due to the low SNR and/or clipping, the sound may be heavily distorted and may result in a complete saturation of the audio signal path. The cascading configuration 800 may thus not perform well a windy environment.

In a windy environment, instead of a microphone, another detector may be used that is not sensitive to air pressure variations but sensitive to vibrations of the human body caused by the utterance of speech. The vocal cords create vibrations that propagate through the body, causing vibrations in the bones and the skin. A vibration sensor in contact with the human body may pick up these signals. Yet, high frequency components are strongly attenuated by the propagation through the human tissue, and typically only low frequency components arrive at the vibration sensor.

Figure 10A:
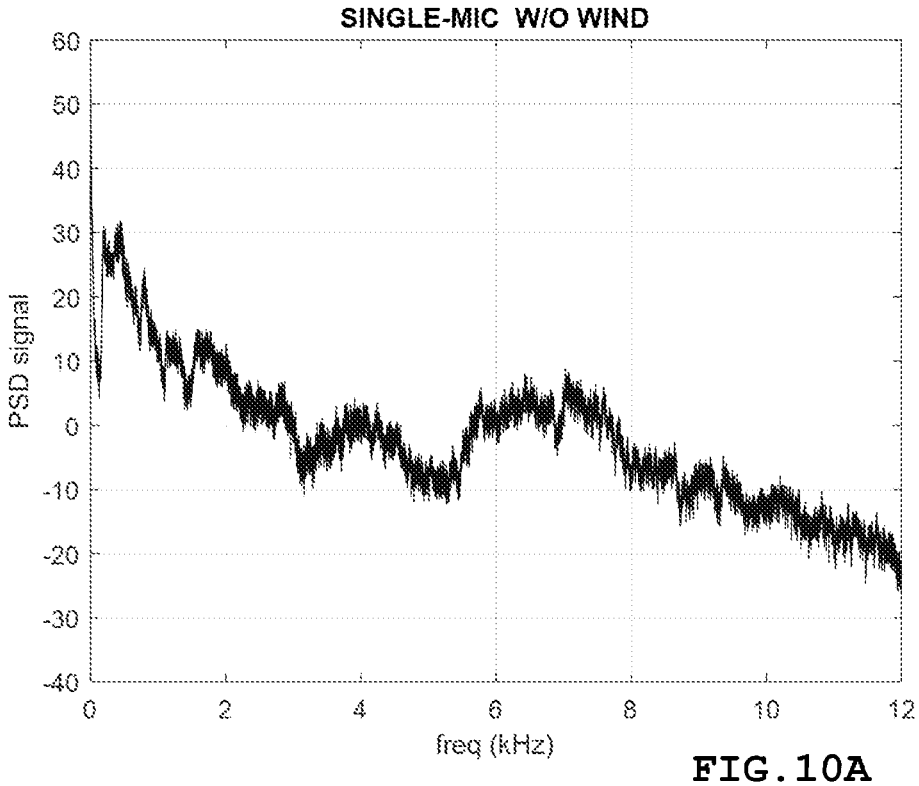
FIG. 10A shows a typical frequency spectrum of a 30 s female voice recorded by a single microphone.
Figure 10B:
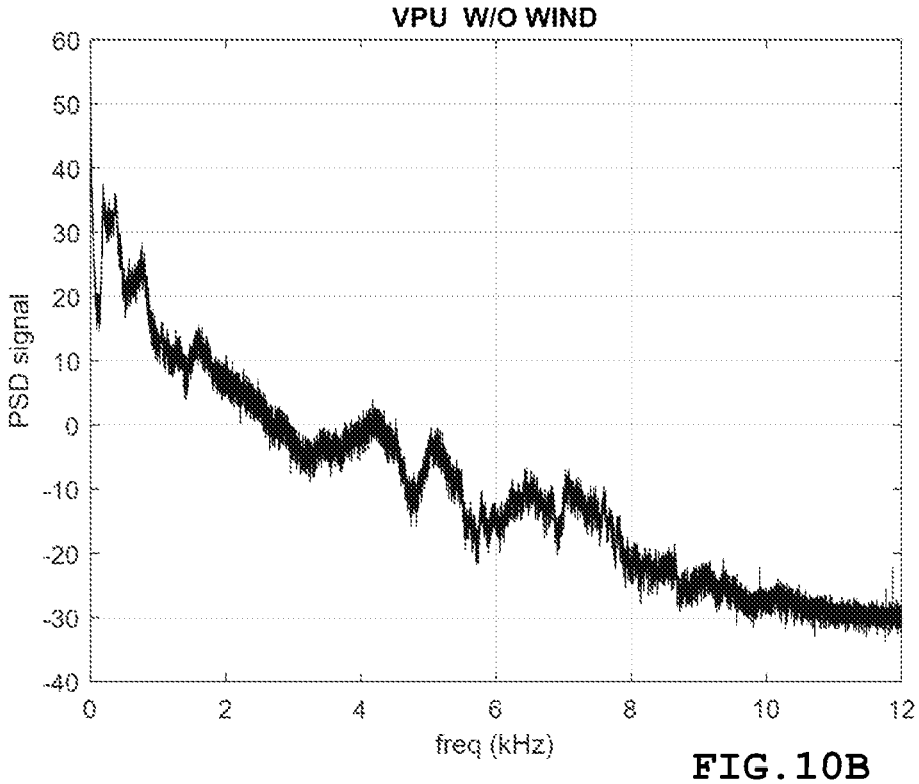
FIG. 10B shows a typical frequency spectrum of the same 30 s female voice recorded by a vibration sensor.

A power spectrum of the same female voice picked by a vibration sensor is depicted in FIG. 10B. Again, for reference, the original power spectrum is shown in FIG. 10A. It is observed that the vibration detector primarily senses the lower frequency components of the voice. Above 4 kHz, the signal is strongly attenuated. As a result, the voice will sound less natural, more muffled. However, the voice will still be intelligible, even in a windy environment.

Figure 11:
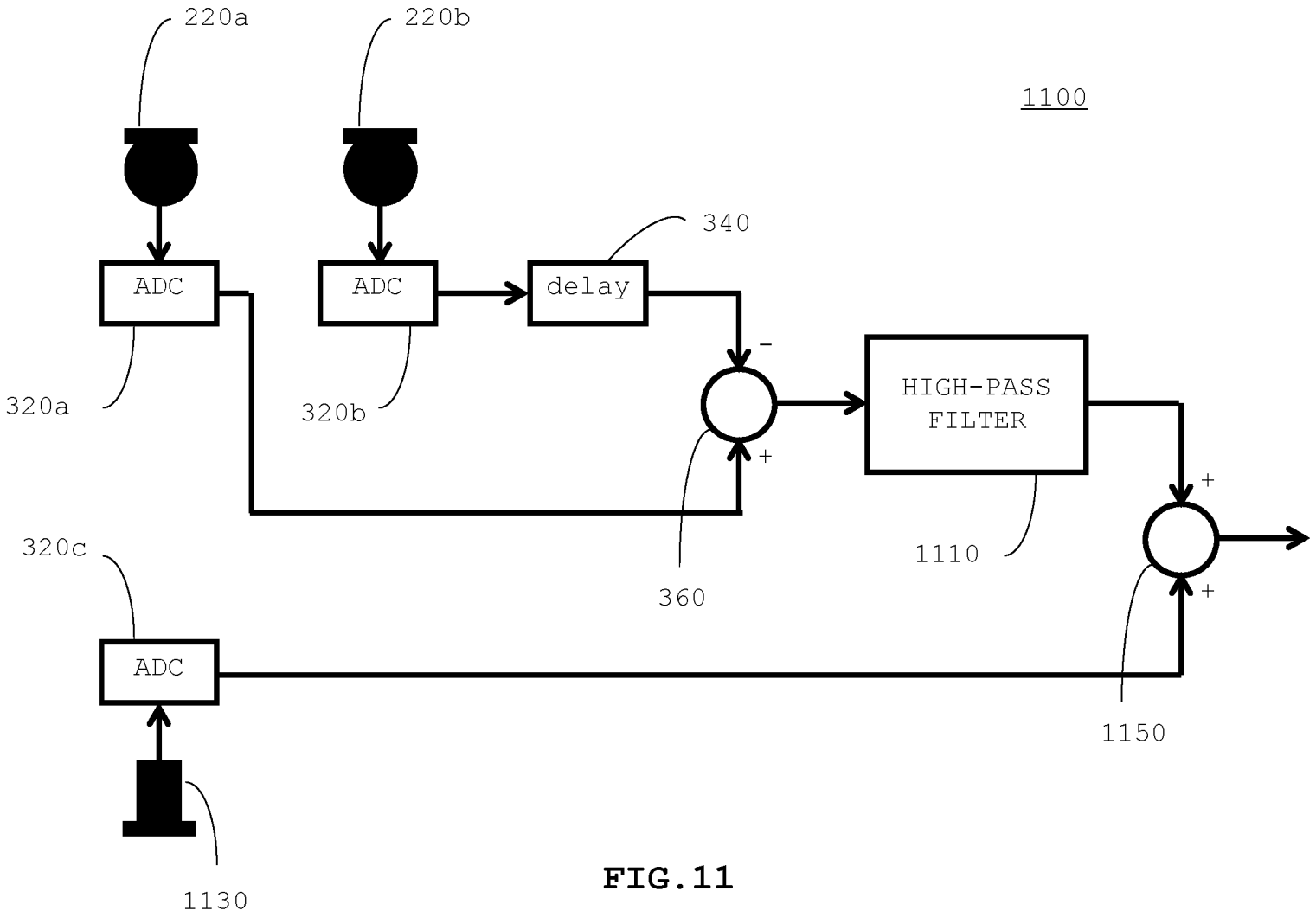
FIG. 11 is a circuit diagram of a dual-microphone arrangement with a high-pass filter and a vibration sensor to operate in windy conditions according to a first embodiment.

Combining the dual-MIC arrangement 300 having the high-pass characteristics with a vibration sensor having the low-pass characteristics is the first step towards improving the acoustic performance of the dual-MIC arrangement. This is shown in the block diagram of FIG. 11. Since wind is typically not suppressed by the dual-MIC arrangement 300, an additional high-pass filter 1110 may further suppresses the low frequency components at the output of the dual-MIC arrangement 300. Filter 1110 can, for example, be a high-pass raised-cosine filter with a −3 dB frequency of 4 kHz and $\alpha$=0.5. Vibration sensor 1130 may pick up the low-frequency voice components; this signal may be converted into the digital domain by A/D converter 320*c* and added to the filtered dual-MIC signals in adder 1150. Arrangement 1100 may provide beam-forming through the dual-MIC arrangement 300 but is also resilient towards wind noise because low frequencies are suppressed by the high-pass filter 1110 and replaced by low-frequency signals from the vibration sensor 1130.

In the arrangement 1100, the voice typically sounds a little distorted since the vibration sensor does not perfectly replicate the low frequency content found in the original voice signal. Even if no wind is present, and a vibration sensor would not be necessary, the voice signal may sound distorted. The equalizer filter 810, as discussed before, does a better job in recreating the low-frequency voice content, but it was very sensitive to wind noise in the dual-MIC arrangement.

Figure 12:
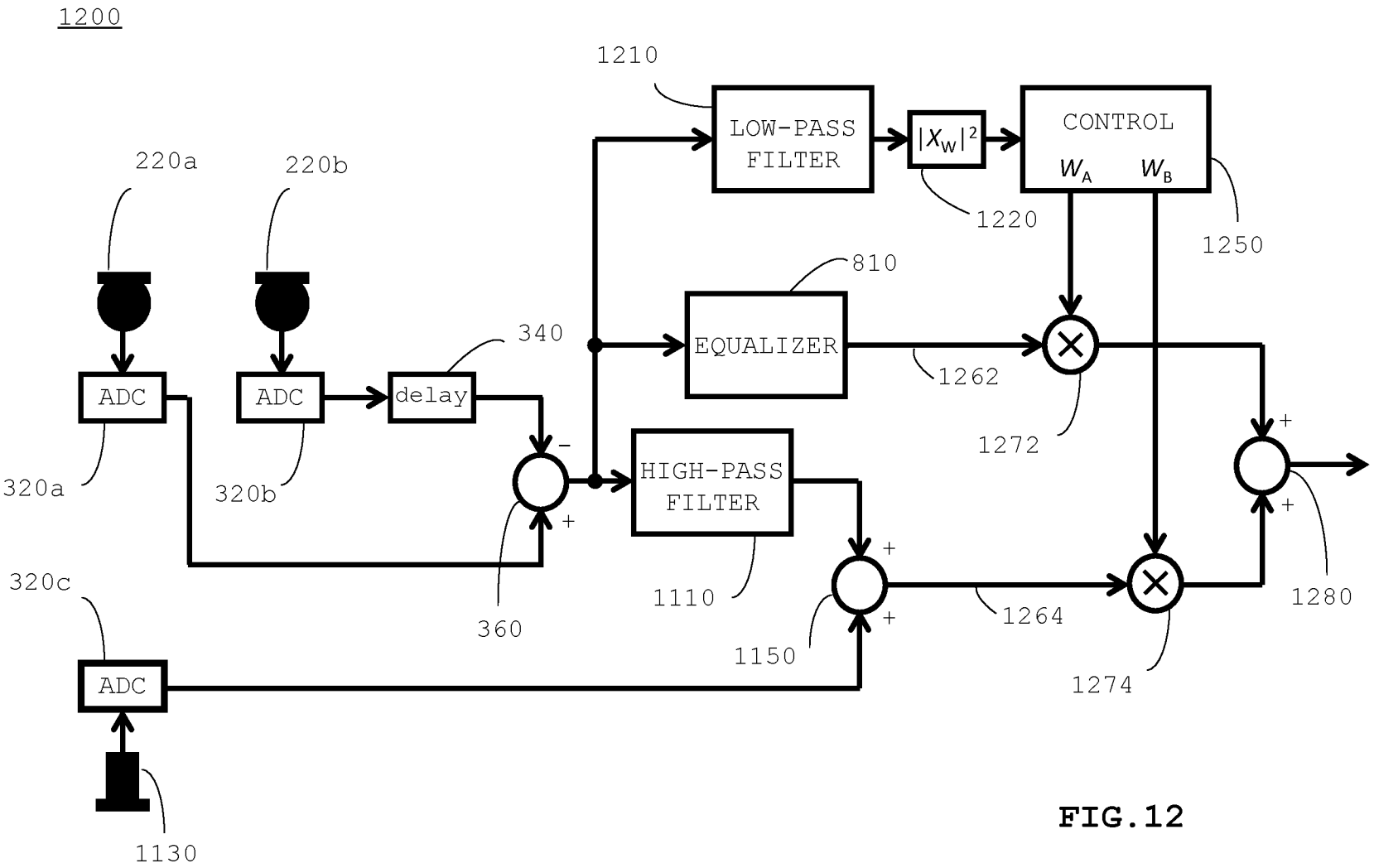
FIG. 12 is a circuit diagram of a first dual-microphone arrangement with an equalizer, a high-pass filter, and a vibration sensor, combined with a wind sensor arrangement to control the equalizer and vibration sensor outputs according to the first embodiment.

In the embodiment 1200 of FIG. 12, the dual-MIC arrangement 800 with equalizer 810 and the dual-MIC arrangement 1100 with high-pass filter 1110 and vibration sensor 1130 have been combined. The equalizer filter 810 has returned, but it may be operational only when there is no wind noise. The power of the wind noise may first be measured at the output of the dual-MIC arrangement 300 (which is equal to the input of the high-pass filter 1110). The detected signal may be low-pass filtered in low-pass filter 1210 (to remove any impact from the voice signal) for example using a low-pass raised-cosine filter with a −3 dB frequency of 200 Hz and $\alpha$=0.5. The filtered signal may then be squared in 1220 to obtain a power level. Control block 1250 may use the measured power level to determine how much weight $W_A$ has to be placed on the equalized dual-MIC signal 1262 and how much weight $W_B$ has to be placed on the combined vibration sensor/high-pass filtered dual-MIC signal 1264. After multiplication in multipliers 1272, 1274, the two signals may be added in adder 1280.

Figure 13:
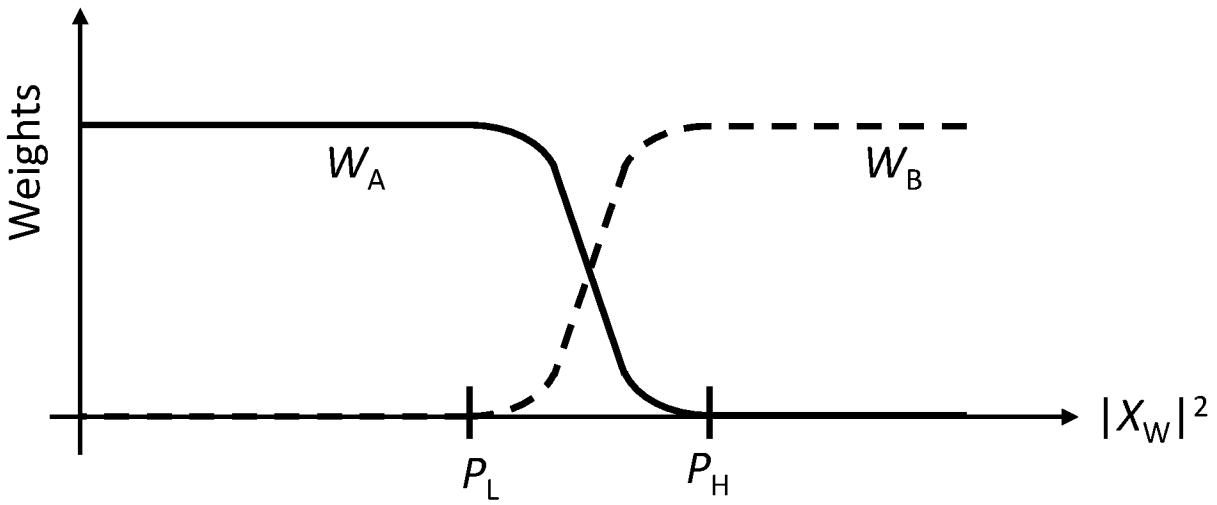
FIG. 13 shows an example of the weight factors applied to the equalizer and vibration sensor outputs as a function of the wind power.

The weighting values $W_A$ and $W_B$ may depend on the measured wind power. An example of the variation in the weights as the wind power varies is shown in FIG. 13. Below wind power threshold $P_L$, the wind is negligible, and the entire output may be derived from the equalized dual-MIC signal 1262: $W_A$=1 and $W_B$=0. If the wind power is higher than the upper threshold $P_H$, the entire output may be derived from the combined vibration sensor/high-pass filtered dual-MIC signal 1264: $W_A$=0 and $W_B$=1. Between $P_L$ and $P_H$, $W_A$ gradually drops, and $W_B$ gradually rises as the wind power increases, respectively. The exact functions may depend on the implementation and preferably the data points are put in a look-up table.

Figure 14:
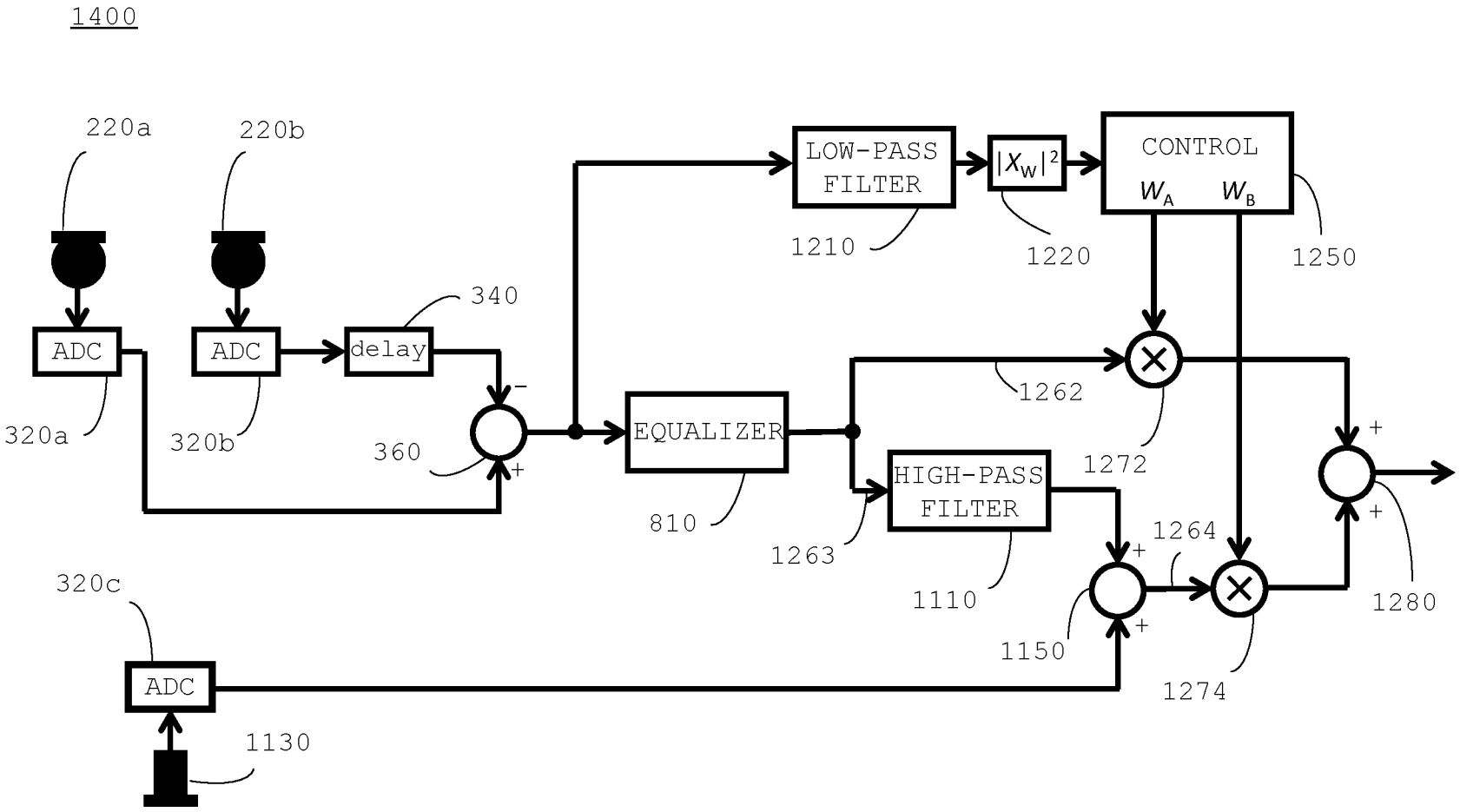
FIG. 14 is a circuit diagram of a first dual-microphone arrangement with an equalizer, a high-pass filter, and a vibration sensor, combined with a wind sensor arrangement to control the equalizer and vibration sensor outputs according to a second embodiment.

An alternative circuit diagram to the dual-MIC arrangement with vibration sensor to provide robustness in noisy wind conditions is shown in FIG. 14. It uses the embodiment 800 shown in FIG. 8 with the equalizer 810 directly following the dual-MIC arrangement 300. The equalizer output splits into two paths: one path via 1262 may be emphasized when the wind conditions are low to moderate, and the weighting $W_A$ is close to 1; another path via 1263 may be emphasized when the wind conditions are severe, the high-frequency components from the dual-MIC arrangements are added to the vibration sensor output, and the weighting $W_B$ is close to 1. Wind noise power may be derived at the output of the dual-MIC arrangement similar as was discussed for the configuration shown in FIG. 12. Based on the measured wind power, the proper values of $W_A$ and $W_B$ may be selected by control unit 1250. Alternatively, the wind noise power may be measured after the equalizer 810, i.e. the input of the low-pass filter 1210 is connected to the output of the equalizer 810 instead of to its input (not shown). This will not impact the functionality but may result in different thresholds in control unit 1250 and in the way the weighting factors $W_A$ and $W_B$ are determined.

Figure 15:
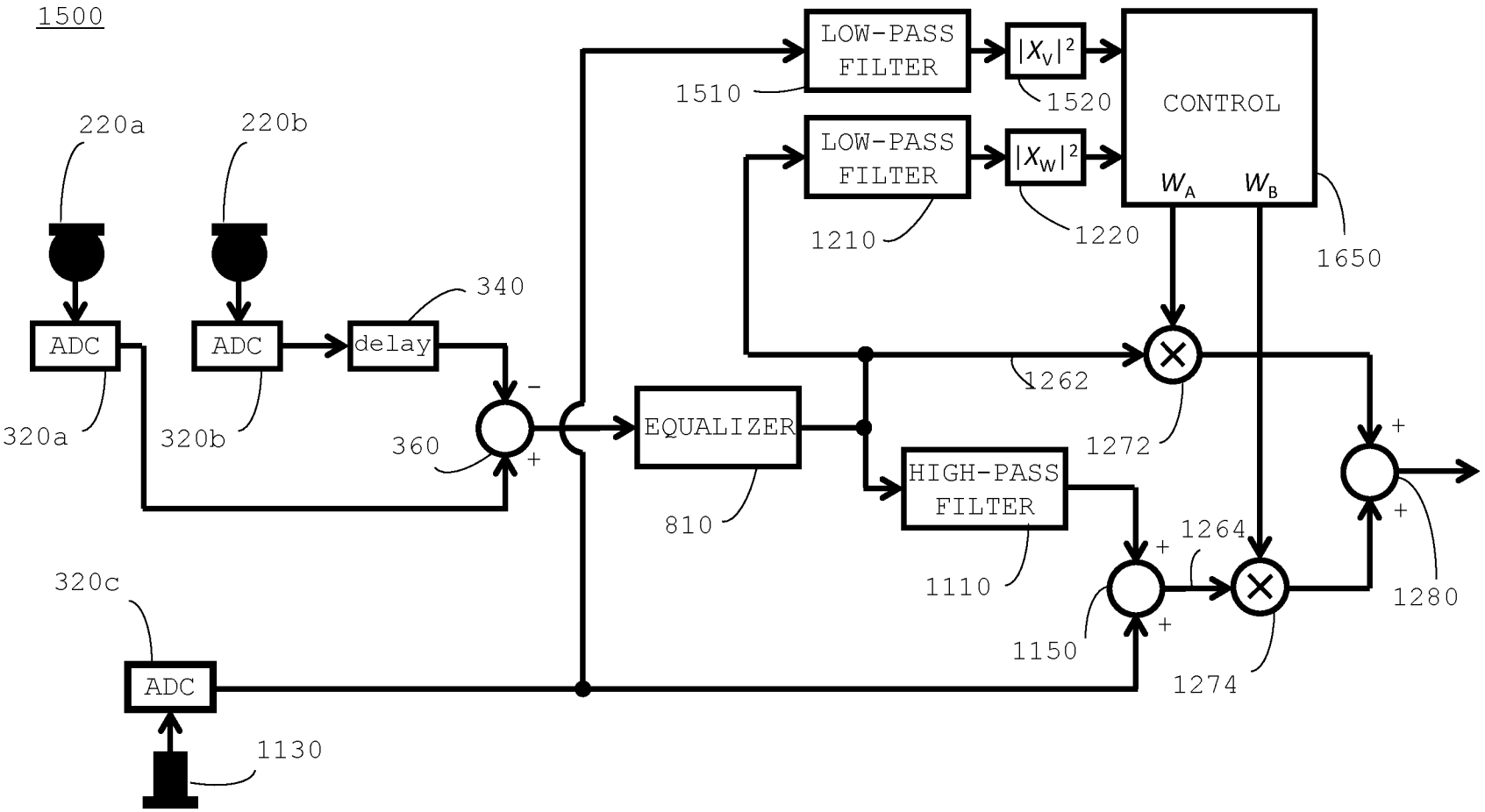
FIG. 15 is a circuit diagram of a second dual-microphone arrangement with an equalizer, a high-pass filter, and a vibration sensor, combined with a wind sensor arrangement to control the equalizer and vibration sensor outputs according to the second embodiment.

Further improvements to measure the wind noise power are shown in FIG. 15. The circuit shown in FIG. 15 differs in the way the weighting factors $W_A$ and $W_B$ are determined. The wind noise power may be derived after the equalizer 810, using low-pass filter 1210 and squarer 1220. However, in addition, the output of the vibration sensor may be used, may be low pass filtered in 1510, and may be squared in 1520. At low wind conditions, the output of the equalizer 810 and the output of the vibration sensor 1130 may be quite similar as they both pick up the low-frequency components of the voice signal. However, at windy conditions, the equalizer 810 may emphasize the wind noise. The power measured at the equalizer output may therefore be much higher than the power of the vibration sensor.

Figure 16:
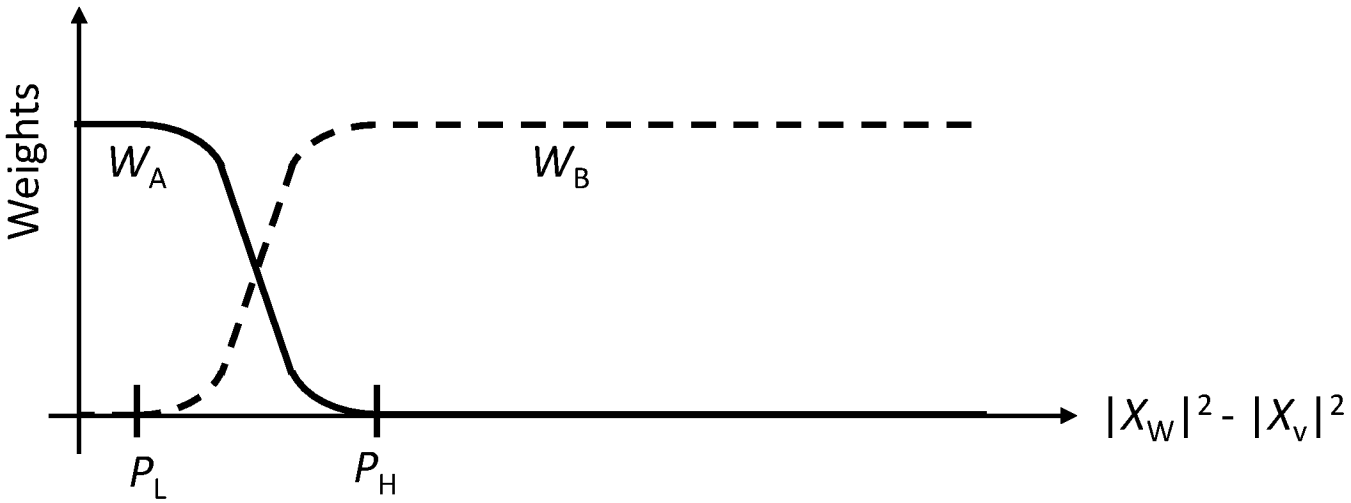
FIG. 16 shows an example of the weight factors applied to the equalizer and vibration sensor outputs as a function of the wind signal power and the vibration sensor signal power.

FIG. 16 shows how the weights $W_A$ and $W_B$ may depend on the difference in the measured power from the wind signal $|X_W|^2$ and the measured power from the vibration sensor signal $|X_v|^2$.

Figure 17:
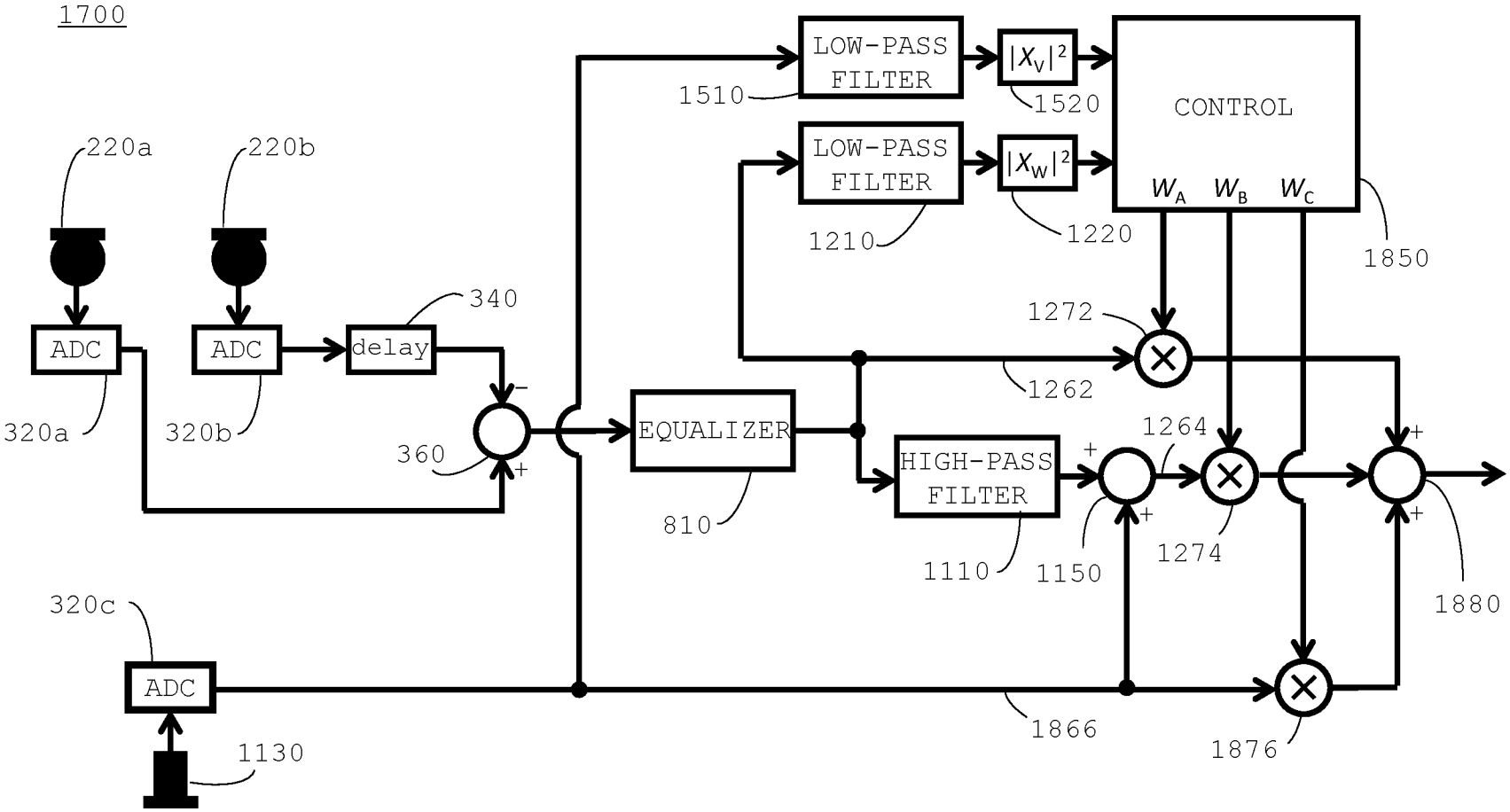
FIG. 17 is a circuit diagram of a third dual-microphone arrangement with an equalizer, a high-pass filter, and a vibration sensor, combined with a wind sensor arrangement to control the equalizer and vibration sensor outputs according to the second embodiment.
Figure 18:
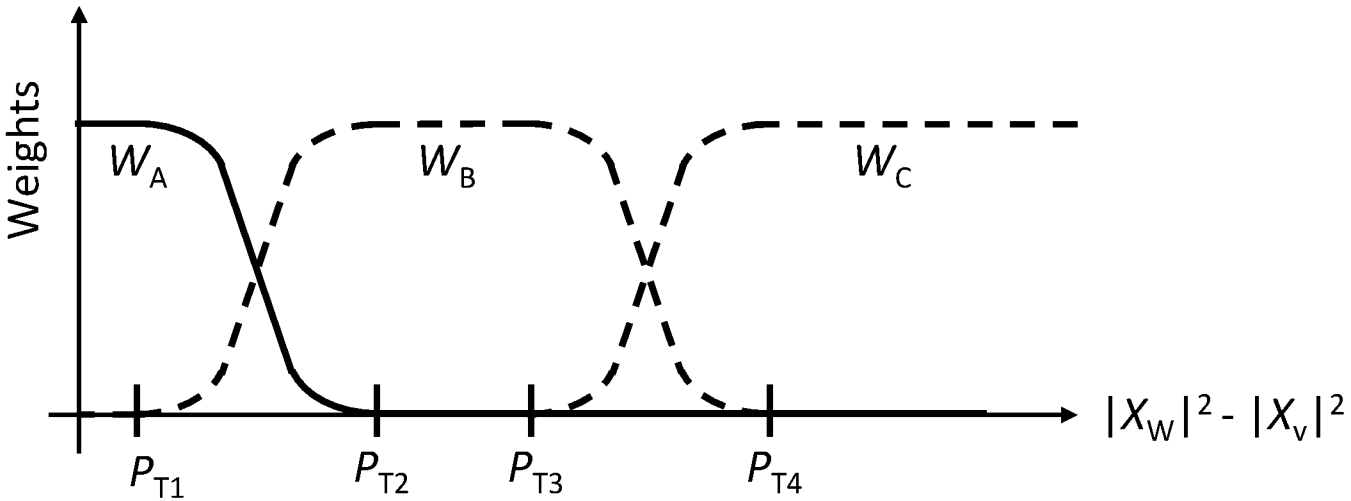
FIG. 18 shows an example of the weight factors applied to the equalizer and vibration sensor outputs as a function of the wind signal power and the vibration sensor signal power in conjunction with FIG. 17.

In certain environments, the wind noise may be so strong that the SNR level, even at the higher frequencies, is too low for an acceptable voice quality to be experienced. In those cases, the high frequency components picked up by the MICs 220*a*, 220*b* are preferably not combined with the signal 1866 from the vibration sensor 1130 as was done previously. Instead, only the signal from the vibration sensor 1130 may be used. In this case, we can distinguish between three wind regimes: 1) low to no wind, 2) moderate wind, and 3) strong wind. In regime 1, the equalizer may be used to compensate for the dual-MIC high pass filtering; in regime 2, the equalizer is not used but the vibration sensor 1130 may be used with the high-frequency dual-MIC signals; finally, in regime 3 only the signal from the vibration sensor 1130 signal may be used. An exemplary schematic 1700 for adaptively control between these three regimes is shown in FIG. 17. This schematic 1700 may be based on configuration 1500 shown in FIG. 15. Similar embodiments could be drawn based on the schematics 1200 or 1400 shown in FIGS. 12 and 14, respectively. In FIG. 18, a third weighting factor $W_C$ is added in control unit 1850 controlling the signal 1866 directly (be it possibly via ADC 320*c*) from the vibration sensor output via multiplier 1876. The control unit 1850 now mixes the following signals: the signal 1262 from the equalizer, the signal 1264 combining the high-passed filtered equalized dual-MIC output with the vibration sensor output, and the signal 1866 directly from the vibration sensor output. Adder 1880 may combine all signals.

In FIG. 18 an example is shown how the different weight factors $W_A$, $W_B$, and $W_C$ vary as a function of the measured wind noise. Four different threshold levels $P_{T1}$, $P_{T2}$, $P_{T3}$, and $P_{T4}$ are shown.

In an alternative embodiment (not shown), adder 1150 in the schematics 1800 in FIG. 17 may be omitted, since the vibration sensor output 1866 is already added in the last adder 1880. This omission will have no effect on the functioning of the system but may require other settings of the weighting factors $W_A$, $W_B$, and/or $W_C$, different from the settings depicted in FIG. 18.

Various operations in the digital domain have been described like adders, subtractors, high- and low-pass filters, equalizing filters, delays, and so on. Several other audio operations may be added to the dual-MIC arrangement with equalizer shown in this invention in order to improve the voice pick-up function. For example, noise suppression, echo cancellation, active noise cancellation, and other audio enhancement functions may be added. All these operations can be carried out in different places in the wireless headset configuration. For example, some (or all) may be carried out in the audio codec 260. Others (or all) may be carried out in the microprocessor 270 or in an addition Digital Signal Processor DSP (not shown).

Figure 19:
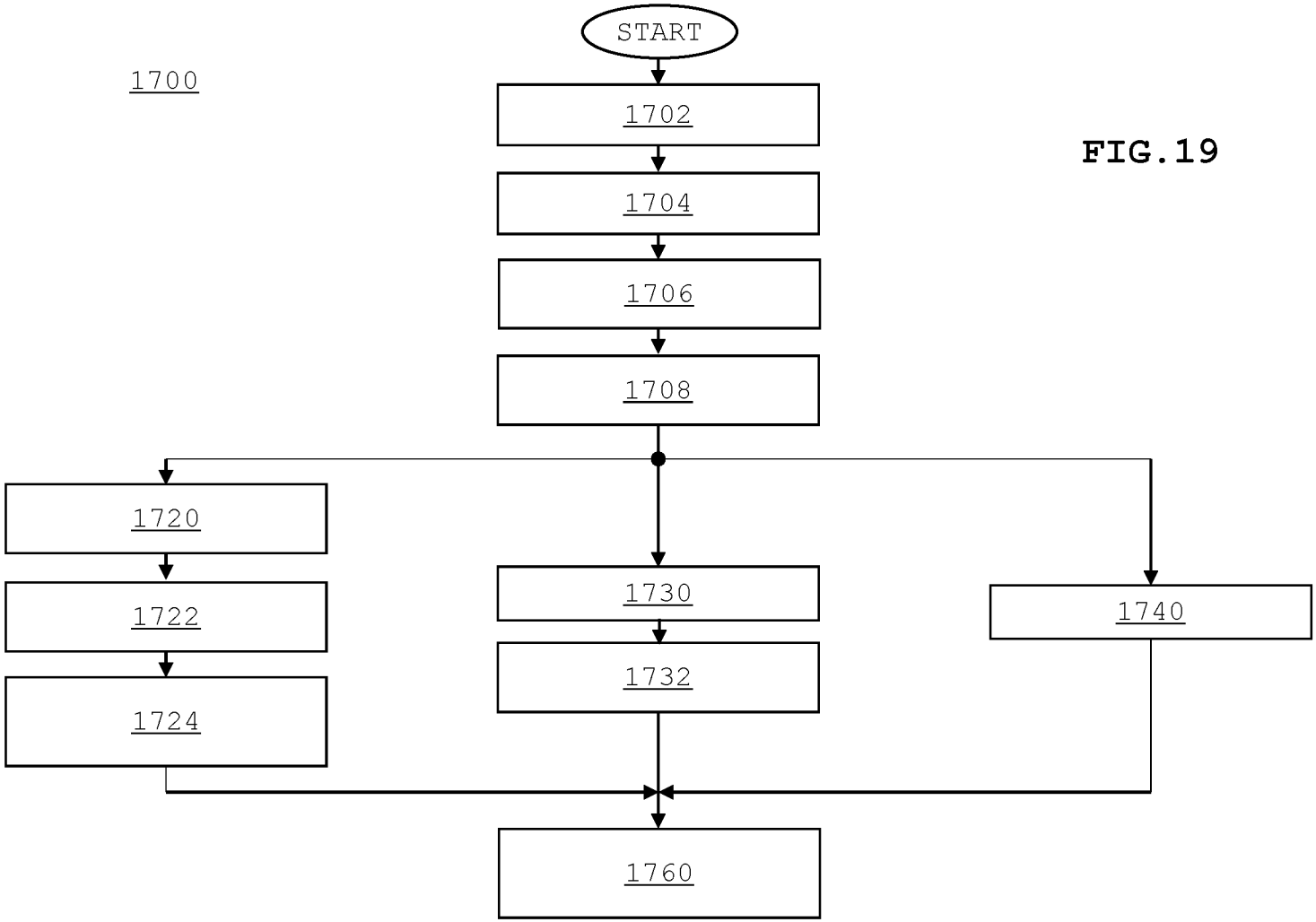
FIG. 19 is a flow diagram of a method to reduce wind noise in an embodiment according to the current invention.

FIG. 19 is a flow diagram of an exemplary method 1700 of using two MICs, an equalizer, and a vibration sensor to achieve improved audio performance in windy and wind-free noise conditions. In step 1702, sound that includes both the voice sound and possibly a first wind sound component may be detected by the first MIC 220*a* and converted into the digital domain. In step 1704, sound that includes both the voice sound and possibly a second wind sound component (which is substantially uncorrelated from the first wind sound component), may be detected by the second MIC 220*b* and converted into the digital domain. In step 1706, sound that includes mainly the voice sound may detected by the vibration sensor 1130 and converted into the digital domain. The delayed output of the second MIC 220*b* may be subtracted from the output of the first MIC 220*a* in step 1708.

To measure the power of the wind, in step 1720 the output of the subtractor may be low-pass filtered, e.g. with a low-pass cut-off frequency of 200 Hz, and then the power in the filtered signal may be determined. The output of the vibration sensor may be low-pass filtered, e.g. with a low-pass cut-off frequency of 200 Hz, and then the power in the filtered signal may be determined in step 1722. From the wind power and possibly the vibration power, the weight factors $W_A$ and $W_B$ may be derived in step 1724.

In step 1730, the subtractor output determined in step 1708 may be high pass filtered to reduce any possible wind noise power. The cut-off frequency for the high-pass filter is for example 4 kHz. In step 1732, the output of the high-pass filter may be added to the output of a vibration sensor that has picked up the voice.

In step 1740, the subtractor output determined in 1708 may be equalized to enhance the low-frequency content of the signal.

Finally, in step 1760, the output of the equalizer may be multiplied with $W_A$, and the output of the adder combining the vibration sensor with the high pass filtered subtractor output, may be multiplied with $W_B$. Both multiplier outputs may then be added together to obtain the output signal to be audibly presented, for example via speaker 210.

Embodiments of the present invention present numerous advantages over the prior art. By exploiting beam-forming using a dual-microphone arrangement with equalization, gain in voice pickup may be achieved while keeping a natural sound in low-wind conditions. When wind is detected, the system may gradually switch over to a voice pickup by a vibration sensor which is insensitive to wind.

The invention claimed is:

1. A method of improving voice pickup in a wireless headset, characterized by:

picking up a voice signal in a first microphone to obtain a first microphone output; picking up the voice signal in a second microphone to obtain a second microphone output; subtracting a delayed version of the second microphone output from the first microphone output to obtain a first processed voice signal;

picking up and processing the voice signal by a vibration sensor to obtain a second processed voice signal; and combining the first processed voice signal and the second processed voice signal to obtain an output signal.

2. The method according to claim 1, wherein the output signal predominantly comprises the first processed voice signal in low-wind conditions, and wherein the output signal gradually switches over to the second processed voice signal with increasing wind conditions.

3. The method according to claim 2, wherein the output signal is only based on the second processed voice signal and does not comprise the first processed voice signal.

4. The method according to claim 1, further comprising:

high-pass filtering the first processed voice signal to obtain a high-pass filter output; and adding the second processed voice signal to the high-pass filter output to add low-frequency content to obtain an adder output, wherein the output signal is based on the adder output.

5. The method according to claim 4, further comprising:

equalizing the first processed voice signal to restore a low-frequency content of the voice signal and obtain an equalized output; and combining the equalizer output and the adder output before obtaining the output signal.

6. The method according to claim 5, wherein the combining of the equalizer output and the adder output depends on an amount of wind noise, wherein weight factors are applied to the equalizer output and the adder output when combining the equalizer output and the adder output, wherein the weight factors are dependent on the amount of wind noise.

7. The method according to claim 6, wherein the amount of wind noise is determined by determining at least one of:

a signal power of a low-pass filtered first processed voice signal;

a signal power of a low-pass filtered equalizer output;

a signal power of a low pass filtered second processed voice signal.

8. The method according to claim 6, wherein the equalizer output is given more weight when the wind noise is low.

9. The method according claim 6, wherein the equalizer output is given less weight when the wind noise is high.

10. A system for improving voice pickup in a wireless headset, the system comprising:

a first microphone configured to pick up a voice signal to obtain a first microphone output;

a second microphone configured to pick up the voice signal to obtain a second microphone output;

a subtractor configured to subtract a delayed version of the second microphone output from the first microphone output to obtain a first processed voice signal;

a high-pass filter configured to high-pass filter the first processed voice signal to obtain a high-pass filter output;

a vibration sensor configured to pick up the voice signal to obtain a second processed voice signal; and an adder configured to add the second processed voice signal to the high-pass filter output to add low-frequency and to obtain an adder output, wherein an output signal of the system is based on the adder output.

11. The system according to claim 10, comprising a control unit configured to adjust the output signal such that the output signal predominantly comprises the first processed voice signal in in low-wind conditions and wherein the output signal gradually switches over to the second processed voice signal with increasing wind conditions, possibly to a state wherein the output signal is only based on the second processed voice signal and does not comprise the first processed voice signal.

12. The system according to claim 10, further comprising:

an equalizer configured to equalize the first processed voice signal to restore a low-frequency content of the voice signal and obtain an equalized output; and a combiner configure to combine the equalizer output and the adder output before obtaining the output signal.

13. The system according to claim 12, wherein the combiner is configured to generate the output depending on an amount of wind noise, wherein weight factors are applied to the equalizer output and the adder output when combining the equalizer output and the adder output, wherein the weight factors are dependent on the amount of wind noise.

14. The system according to claim 13, wherein the amount of wind noise is determined by determining at least one of:

a signal power of a low-pass filtered first processed voice signal;

a signal power of a low-pass filtered equalizer output;

a signal power of a low pass filtered second processed voice signal.

15. The method according to claim 13, wherein the equalizer is configured such that the equalizer output is given more weight when the wind noise is low.

16. The method according claim 13, wherein the equalizer is configured such that the equalizer output is given less weight when the wind noise is high.

17. A wireless headset comprising the system according to claim 10.

18. The wireless headset according to claim 17, wherein the wireless headset comprises a radio transceiver for wireless communication of the output signal to an external device, such as a smartphone.

19. The wireless headset according to claim 18, wherein the radio transceiver is based on BlueTooth™.

* * * * *